US010662941B2

(12) United States Patent
Simpson et al.

(10) Patent No.: US 10,662,941 B2
(45) Date of Patent: May 26, 2020

(54) MODULAR PNEUMATIC WELL PUMP SYSTEM

(71) Applicant: Q.E.D. Environmental Systems, Inc., Dexter, MI (US)

(72) Inventors: David D. Simpson, Discovery Bay, CA (US); Antonio U. Ramirez, San Francisco, CA (US)

(73) Assignee: Q.E.D. Environmental Systems, Inc., Dexter, MI (US)

( * ) Notice: Subject to any disclaimer, the term of this patent is extended or adjusted under 35 U.S.C. 154(b) by 289 days.

(21) Appl. No.: 15/872,435

(22) Filed: Jan. 16, 2018

(65) Prior Publication Data

US 2018/0202436 A1 Jul. 19, 2018

Related U.S. Application Data

(60) Provisional application No. 62/447,625, filed on Jan. 18, 2017.

(51) Int. Cl.
*F04B 53/16* (2006.01)
*F04B 49/04* (2006.01)
(Continued)

(52) U.S. Cl.
CPC ..... *F04B 53/16* (2013.01); *F04B 49/025* (2013.01); *F04B 49/04* (2013.01); *F04B 53/10* (2013.01); *F04F 1/08* (2013.01); *E21B 43/121* (2013.01)

(58) Field of Classification Search
CPC ..... F04F 1/08; F04B 49/04; F04B 49/025; F04B 53/10; F04B 53/16; E21B 43/121
See application file for complete search history.

(56) References Cited

U.S. PATENT DOCUMENTS 1,838,135 A * 12/1931 Derby ..... G01F 23/64 200/84 B
4,018,544 A 4/1977 Eberhardt
(Continued)

FOREIGN PATENT DOCUMENTS

CN 1748072 A 3/2006
CN 201100122 Y 8/2008
(Continued)

OTHER PUBLICATIONS

International Search Report and Written Opinion, International Application No. PCT/US2018/014039, dated Apr. 24, 2018, 9 pages.

*Primary Examiner* — Charles G Freay
(74) *Attorney, Agent, or Firm* — Harness, Dickey & Pierce, P.L.C.

(57) ABSTRACT

The present disclosure relates to a modular fluid pump system for configuring a fluid pump in a selected one of first and second configurations. The system may have a first pump casing with a first diameter, and a second pump casing with a second diameter smaller than the first diameter. A tubular frame may be included along with a first float having a first diameter positioned over the tubular frame for sliding longitudinal movement along the tubular frame. The first pump casing may be used to configure the fluid pump in the first configuration, to thus provide a first degree of clearance between the first float and an inner surface of the first pump casing, or alternatively the second pump casing may be used to configure the fluid pump in the second configuration, which provides a second degree of clearance between the first float and an inner of the second pump casing.

18 Claims, 3 Drawing Sheets

(51) Int. Cl.

| | |
|---|---|
| ***F04B 53/10*** | (2006.01) |
| ***F04B 49/025*** | (2006.01) |
| ***F04F 1/08*** | (2006.01) |
| *E21B 43/12* | (2006.01) |

(56) References Cited

U.S. PATENT DOCUMENTS 4,173,255 A * 11/1979 Kramer ..... E21B 43/12 137/411
5,004,405 A * 4/1991 Breslin ..... F04B 47/08 417/126
5,358,037 A * 10/1994 Edwards ..... F04F 1/08 166/105
5,495,890 A 3/1996 Edwards et al.
5,549,157 A * 8/1996 Johnson ..... F04F 1/08 166/105
5,641,272 A * 6/1997 Harrold ..... F04F 1/08 417/131
5,944,490 A 8/1999 Breslin
5,971,715 A * 10/1999 Breslin ..... F04B 53/1015 137/512.1
6,039,546 A 3/2000 Edwards et al.
6,044,904 A 4/2000 Shafer
6,503,066 B1 * 1/2003 Cantley ..... F04B 9/125 137/593
7,284,961 B2 * 10/2007 Jacobsen ..... F04B 9/125 417/399
10,415,603 B1 * 9/2019 Sommese ..... F04B 9/1276

FOREIGN PATENT DOCUMENTS

| | | | |
|---|---|---|---|
| CN | 102896131 | A | 1/2013 |
| EP | 2055899 | A2 | 5/2009 |
| KR | 20120023267 | A | 3/2012 |

* cited by examiner

MODULAR PNEUMATIC WELL PUMP SYSTEM

CROSS-REFERENCE TO RELATED APPLICATIONS

This application claims the benefit of U.S. Provisional Application No. 62/447,625, filed on Jan. 18, 2017. The entire disclosure of the above application is incorporated herein by reference.

FIELD

The present disclosure relates to well pumps typically used in landfill wells, and more particularly to a modular pump system that can be quickly and easily configured with a limited number of additional parts to be optimized for use with different diameter wells.

BACKGROUND

The statements in this section merely provide background information related to the present disclosure and may not constitute prior art.

Float operated pneumatic pumps have proven to be highly efficient and economical devices for use in groundwater remediation applications. The assignee of the present disclosure has been a leader in the manufacture of such pumps, and is the owner of the following U.S. patents, all of which are hereby incorporated by reference into the present disclosure: U.S. Pat. No. 6,039,546 to Edwards et al.; U.S. Pat. No. 5,358,037 to Edwards et al.; U.S. Pat. No. 5,358,038 to Edwards et al.; and U.S. Pat. No. 5,495,890.

Because float operated pneumatics pumps are often required to pump sludge-like fluids, there is a need for more frequent cleaning. This need for more frequent cleaning arises in part because of the relatively tight clearances within a typical float operated pneumatic pump. For example, the pump illustrated in U.S. Pat. No. 6,039,546 referenced above, is a four inch diameter pump. By that it is meant that the outer casing of the pump has a four inch diameter. The float inside the casing is about three inch in diameter. As such, the clearances are relatively tight. Therefore, while the four inch casing enables the pump to be used in smaller diameter well bores, the tight internal clearances will naturally give rise to a need for more frequent cleaning. This should not be viewed as a defect in any way; rather, there is simply a tradeoff between a highly compact pump construction that enables use in smaller diameter wells, and the cleaning service interval for the pump.

The cleaning of any float operated pneumatic pump can represent a time intensive endeavor. Depending on how dirty the pump is inside, it may be necessary for extensive disassembly of the pump which is not easy to do in the field, and thus may require taking the pump back to a service facility for a thorough cleaning. Accordingly, any pump construction which reduces the need for cleaning, as well as reduces the risk of fouling of the pump from contaminants, would be welcomed in the industry.

Another limitation with present day pneumatic pumps is the number of independent component parts that must be carried for a manufacturer to construct pumps of different diameters. For example, at the present time there is no easy way to alter a 4.0 inch diameter pump to make it into a 4.5 inch diameter pump. Instead, the user is typically forced to purchase an entirely new pump. And pump manufacturers often are required to carry separate inventories of parts needed to construct two otherwise very similar pumps but which have different diameters. In some applications it would be a significant advantage to be able to easily modify a pump to increase its dimensions, and particularly its diameter. Simply increasing the overall diameter of a pump can significantly reduce the chance of sticking of the float mechanism caused by contaminants such as solid and semi-solids which can coat the surfaces of the float and/or the internal wall of the casing and/or the rod on which the float travels. Providing a greater degree of clearance between the float and the float rod, and between the exterior surface of the float and the interior surface of the pump casing, can dramatically reduce the chance that the interior of the pump will become contaminated to the point of causing the float to stick. If the diameter of the pump could be easily modified by the manufacturer, or possibly even by the end user, to alter the diameter of the pump, then the manufacturer (and possibly even the user) would have the ability to tailor one pump for a greater variety of uses with minimal additional cost and minimal additional component parts. Potentially, the end user might even be able to buy one pump having a first diameter, and be able to reconfigure it as a pump having a second diameter, with only a few additional component parts, and without the need for buying an entirely complete second pump.

SUMMARY

This section provides a general summary of the disclosure, and is not a comprehensive disclosure of its full scope or all of its features.

In one aspect the present disclosure relates to a modular fluid pump system for configuring a fluid pump in a selected one of first and second configurations. The system may comprise a first pump casing having a first diameter, and a second pump casing having a second diameter smaller than the first diameter. The system may further comprise a tubular frame, and a first float having a first diameter positioned over the tubular frame for sliding longitudinal movement along the tubular frame. The system may also comprise an upper support ring coupled to an upper end of the tubular frame, a lower support ring coupled to a lower end of the tubular frame, and an inlet operatively coupled to the lower support ring. The first pump casing may be operatively coupled to the tubular frame to configure the fluid pump in the first configuration, to thus provide a first degree of clearance between the first float and an inner surface of the first pump casing. Alternatively, the second pump casing is operatively coupled to upper and lower support rings in the second configuration, to thus provide a second degree of clearance between the first float and the inner surface of the second pump casing, wherein the second degree of clearance is less than the first degree of clearance.

In another aspect the present disclosure relates to a modular fluid pump system for configuring a fluid pump in a selected one of first and second configurations. The system may comprise a first pump casing having a first diameter, and a second pump casing having a second diameter smaller than the first diameter. The system may further comprise a tubular frame, a first float having a first diameter and being positionable over the tubular frame for sliding longitudinal movement along the tubular frame, and a second float having a second diameter less than the first diameter, the second float also being positionable over the tubular frame for sliding longitudinal movement along the tubular frame. The system may further include an upper support ring coupled to an upper end of the tubular frame, and a lower support ring coupled to a lower end of the tubular frame. The system may further include an upper housing ring coupled to the upper end of the tubular frame, and a lower housing ring coupled to the lower end of the tubular frame. An inlet may also be included which is operatively coupled to the lower support ring. The first pump casing may be positioned over the first float and coupled to the upper and lower housing rings, which are in turn coupled to the tubular frame, to configure the fluid pump in the first configuration. This provides a first degree of clearance between the first float and an inner surface of the first pump casing. Alternatively, the fluid pump may be configured in the second configuration by positioning the second pump casing over the second float and operatively coupling it to upper and lower support rings, without use of the upper and lower housing rings. This provides a second degree of clearance between the second float and an inner surface of the second pump casing, wherein the second degree of clearance is less than the first degree of clearance.

In still another aspect the present disclosure relates to a method for forming a modular fluid pump in a selected one of first and second configurations. The method may comprise initially providing a first pump casing having a first diameter, providing a second pump casing having a second diameter smaller than the first diameter, and providing a tubular frame. The method may further include arranging a first float positioned over the tubular frame for sliding longitudinal movement along the tubular frame, and operatively securing the first pump casing to the tubular frame over the first float, when the modular pump is to be configured in a first configuration. This provides a first degree of clearance between the first float and an inner surface of the first pump casing. The method may further include arranging a second float over the tubular frame in place of the first float, and securing a second pump casing having a second diameter different from the first diameter to the tubular frame, in place of the first pump housing. This provides a second configuration having a second degree of clearance between the second float and an inner surface of the second pump casing.

Further areas of applicability will become apparent from the description provided herein. The description and specific examples in this summary are intended for purposes of illustration only and are not intended to limit the scope of the present disclosure.

BRIEF DESCRIPTION OF THE DRAWINGS

The drawings described herein are for illustration purposes only and are not intended to limit the scope of the present disclosure in any way.

DETAILED DESCRIPTION

Figure 1:
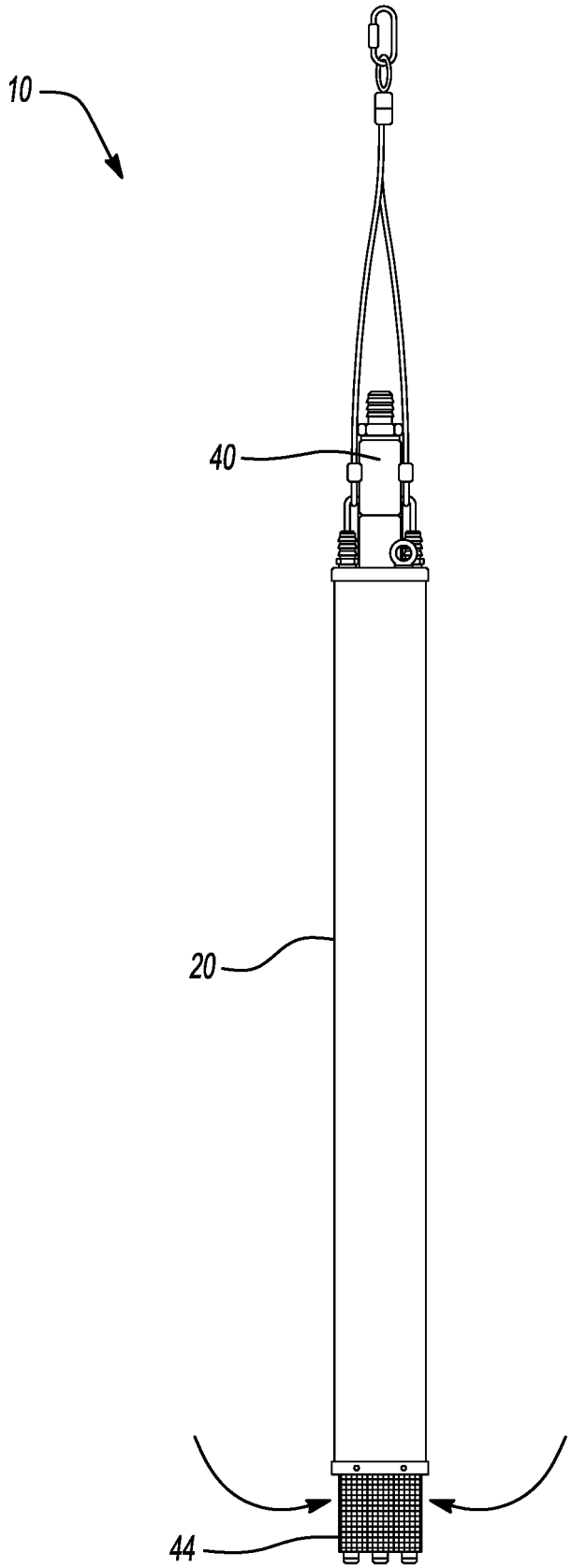
FIG. 1 is a side view of one embodiment of a pump in accordance with the present disclosure.

The following description is merely exemplary in nature and is not intended to limit the present disclosure, application, or uses. It should be understood that throughout the drawings, corresponding reference numerals indicate like or corresponding parts and features.

Figure 2:
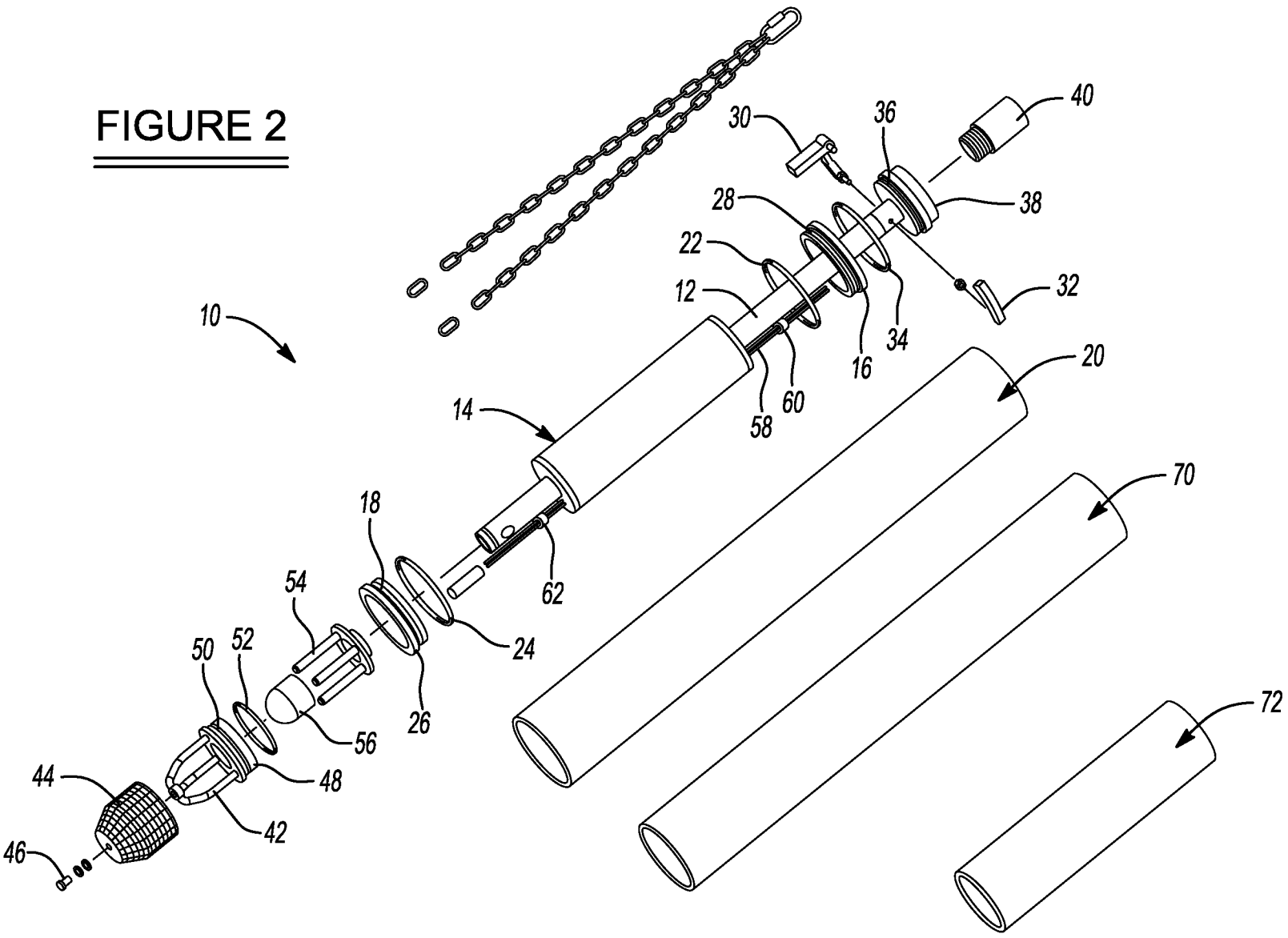
FIG. 2 is an exploded view of the components that make up the pump of FIG. 1 in a first configuration (i.e., having a 4.0 inch diameter), along with additional components that may be used to reconfigure the pump in a second configuration (e.g., having a 4.5 inch diameter)

Referring to FIGS. 1 and 2, a modular pump 10 in accordance with the present disclosure is shown. The pump 10 is modular in that it can be configured in a first configuration with a 4.5 inch (114.3 mm) diameter casing and a 3.5 inch (88.9 mm) diameter float for applications where the pump is expected to encounter sludge-like liquids, and thus can be expected to require cleaning more frequently, and a second configuration in which the pump 10 has a 4.0 inch diameter casing and a 3.0 inch outer diameter float, for those applications where the pump 10 is expected to be used in wells to pump liquids that are less likely to contaminate the pump. The ability to easily configure the pump 10 to two sizes enables the pump to be optimized for the application without the need for maintaining two completely separate, fully assembled pumps.

Referring to FIG. 2, the pump 10 can be seen to include a tubular frame 12, a float 14 positioned over the frame an upper housing ring 16 positioned at an upper end of the frame 12, and a lower housing ring 18 positioned at a lower end of the frame 12. The housing rings 16 and 18 engage upper and lower ends respectively of a 4.5" (114.3 mm) diameter casing 20. O-rings 22 and 24 positioned in grooves 26 and 28 help to maintain a watertight seal at the upper and lower ends of the casing 20 once the pump 10 is fully assembled. It will be appreciated that the housing rings 16 and 18 will be needed when the 4.5" diameter casing 20 is being used, as will be explained further in the following paragraphs.

At the upper end of the pump a lever assembly 30 along with a lever connector 32 to affix the lever to the frame 12. An O-ring 34 may also be placed in a groove 36 on the upper support ring 38, where the upper support ring 38 is fixedly secured to an upper end of the tubular frame 12. A discharge fitting 40 may be coupled to the upper support ring 38 to enable an external tube to be coupled to the pump 10 to enable fluid pumped by the pump to be discharged out from the pump up to a suitable container or reservoir.

The lower end of the frame 12 includes an inlet 42 over which a screen 44 is secured using a threaded screw 46. The inlet 42 also includes a lower support ring 48 having a groove 50 on which an O-ring 52 is disposed. A spider 54 engages a lower end of the frame 12 and captures a poppet 56 therein.

Upward movement of the float 14 upwardly serves to lift a control rod 58 upwardly when a stop 60 contacts the float 14 and the float continues to move upwardly. The control rod 58 communicates with the lever assembly 30 to provide a signal which signals the pump 10 to turn on. Similarly, downward movement of the float 14 eventually causes contact with a lower stop 62, which causes the pump 10 to turn off. Additional details of basic operation of the pump 10 may be found in the above-mentioned patents that have been incorporated by reference into the present disclosure.

Figure 3:
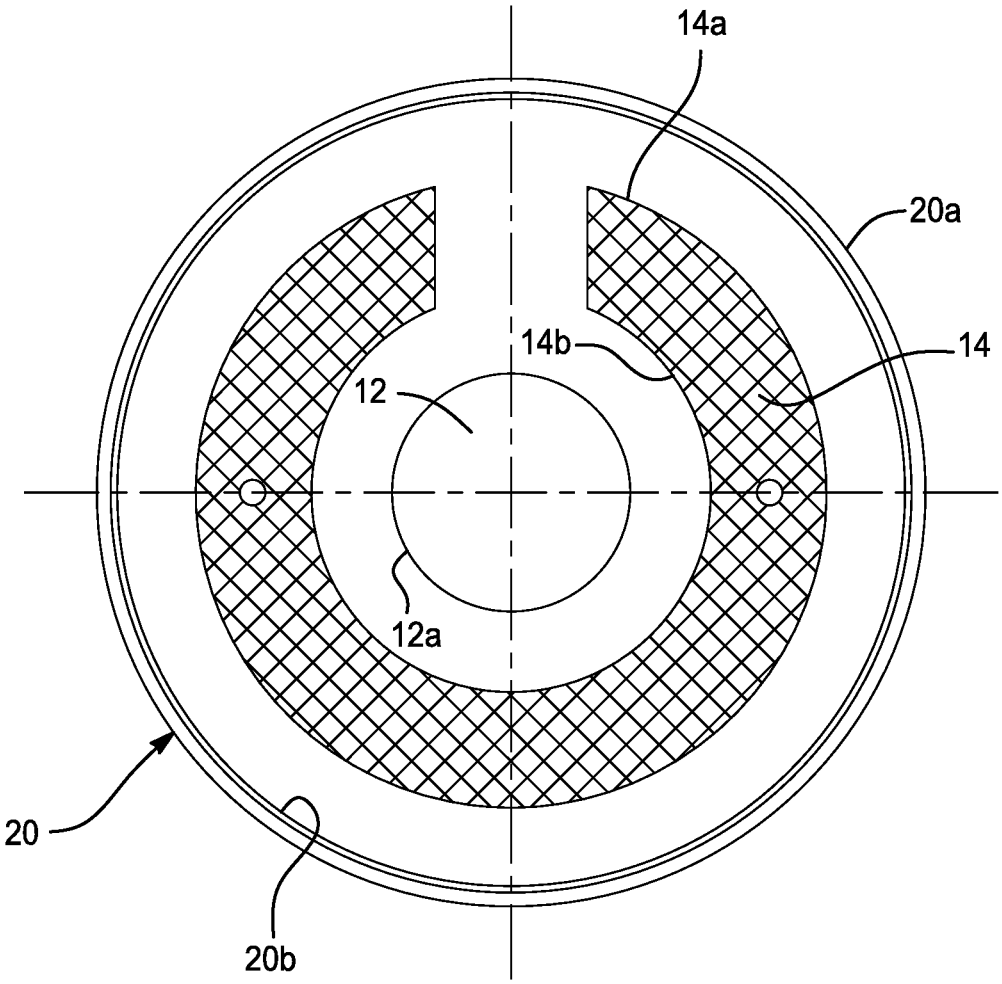
FIG. 3 is a cross sectional end view showing the 4.5" casing with its corresponding float positioned concentrically within it to illustrate the significant additional clearance provided by the 4.5" casing and corresponding float.

FIG. 3 shows the 4.5" (114.3 mm) diameter casing 20 having an outer wall 20*a*. The float 14 has an outer wall 14*a* and an inner wall 14*b*. In this example the clearance between the outer surface 14*a* of the float 14 and the inner surface 20*b* of the casing 20 is about 0.43" (10.92 mm). Similarly, the clearance between the inner surface 20*b* of the float 14 and an outer surface 12*a* of the frame rod is also about 0.43". These are both extremely generous clearances which both help significantly to reduce the possibility of contaminants such as sludge building up within the pump 10 to a degree where the free movement of the float 14 up and down is impeded.

Referring further to FIG. 2, this figure also shows a 4.0 inch (101.6 mm) diameter pump casing 70 and a 3.5 inch (88.9 mm) diameter float 72. The clearances between the outside of the float 72 and an inside wall of the casing, as well as the clearance between the inside of the float 72 and the outer surface 12*a* of the frame rod, are less than with the float 14 and casing 20. The tradeoff is that the overall outer diameter of the pump 10, when configured with the float casing 70 and the float 72, will be more compact and possibly useable in applications where the diameter of the well bore needs to be kept as small as possible. When using the 4.0" (101.6 mm) diameter pump casing 70, housing rings 16 and 18 will not be required and will therefore not be used when assembling the pump 10. Instead, the opposing ends of the 4.0" pump casing will attach directly to the upper support ring 38 and the lower support ring 48 during assembly of the pump 10.

An important advantage of the pump 10 is that its modular construction allows a significant reduction in the pump inventory of a manufacturer, and also enables both configurations to be made less expensively because of the large number of common parts that can be used in both the 4.5" and 4.0" configurations of the pump. A manufacturer need only stock the pump 10 in one of its configurations (e.g., its 4.5" configuration), and the pump can be easily reconfigured prior to sale in the other configuration if needed. In other words, separate 4.5" and 4.0", fully assembled pumps do not necessarily need to be stocked.

And while the pump 10 has been described as having a modular construction that enables the pump to be constructed with one of two different diameters, it will be appreciated that the invention is not limited to use with only two different sized casings and floats. For example, the pump 10 may be constructed with three or more different sized casings and three or more different diameter floats to meet the needs of different applications.

The modular pump 10 of the present disclosure can thus be readily configured in a manufacturing/assembly environment with one of at least two different diameter casings and floats. Reconfiguration of the pump 10 from one configuration to another is easily achieved with only a minimal number of additional parts and with no significant variation in assembly/disassembly procedures. One of the two configurations may use a larger float with greater clearance between the exterior surface of the float and the interior surface of the casing, as well as increased clearance between the inside of the float and a frame rod over which the float slides. The increased clearance significantly reduces the possibility of the float becoming stuck from a buildup of sludge or other contaminants around the moving internal parts of the pump and significantly reduces the time interval between pump cleanings.

While various embodiments have been described, those skilled in the art will recognize modifications or variations which might be made without departing from the present disclosure. The examples illustrate the various embodiments and are not intended to limit the present disclosure. Therefore, the description and claims should be interpreted liberally with only such limitation as is necessary in view of the pertinent prior art.

What is claimed is:

1. A modular fluid pump system for configuring a fluid pump in a selected one of first and second configurations, the system comprising:

a first pump casing having a first diameter;

a second pump casing having a second diameter smaller than the first diameter;

a tubular frame;

a first float having a first diameter positioned over the tubular frame for sliding longitudinal movement along the tubular frame;

an upper support ring coupled to an upper end of the tubular frame;

a lower support ring coupled to a lower end of the tubular frame;

an inlet operatively coupled to the lower support ring; and wherein either:

the first pump casing is operatively coupled to the tubular frame to configure the fluid pump in the first configuration, to thus provide a first degree of clearance between the first float and an inner surface of the first pump casing; or the second pump casing is operatively coupled to upper and lower support rings in the second configuration, to thus provide a second degree of clearance between the first float and the inner surface of the second pump casing, wherein the second degree of clearance is less than the first degree of clearance.

2. The system of claim 1, further comprising:

upper and lower housing rings coupled to the tubular frame adjacent opposing ends of the tubular frame, the upper and lower housing rings only being employed when the fluid pump is being configured in the first configuration.

3. The system of claim 2, wherein when the second pump casing is being used to construct the modular fluid pump, the second pump casing is secured to the upper and lower housing rings.

4. The system of claim 3, wherein the upper and lower housing rings each include a groove and an O-ring disposed in the groove.

5. The system of claim 1, further comprising a second float having an outer diameter less than an outer diameter of the first float, for use in place of the first float when the second pump casing is being used to construct the modular fluid pump.

6. The system of claim 1, further comprising a valve assembly, wherein the valve assembly includes:

a poppet; and a spider for containing the poppet, the spider being disposed within the inlet.

7. The system of claim 6, further comprising a screen disposed over the inlet.

8. The system of claim 1, further comprising:

a control rod operatively associated with the float;

a first stop element secured to the control rod;

a second stop element secured to the control rod at a location different from the first stop element; and a lever assembly movable by the first float in response to contact by the first float with the first stop element during movement of the float in a first direction, to cause the modular pump to turn on; and the lever assembly operating to cause the modular pump to turn off when the float moves in a second direction opposite to the first direction and contacts the second stop element.

9. A modular fluid pump system for configuring a fluid pump in a selected one of first and second configurations, the system comprising:

a first pump casing having a first diameter;

a second pump casing having a second diameter smaller than the first diameter;

a tubular frame;

a first float having a first diameter and being positionable over the tubular frame for sliding longitudinal movement along the tubular frame;

a second float having a second diameter less than the first diameter, the second float also being positionable over the tubular frame for sliding longitudinal movement along the tubular frame;

an upper support ring coupled to an upper end of the tubular frame;

a lower support ring coupled to a lower end of the tubular frame;

an upper housing ring coupled to the upper end of the tubular frame;

a lower housing ring coupled to the lower end of the tubular frame;

an inlet operatively coupled to the lower support ring; and wherein either:

the first pump casing is positioned over the first float and coupled to the upper and lower housing rings, which are in turn coupled to the tubular frame, to configure the fluid pump in the first configuration, to thus provide a first degree of clearance between the first float and an inner surface of the first pump casing; or the second pump casing is positioned over the second float and operatively coupled to upper and lower support rings in the second configuration, without use of the upper and lower housing rings, to thus provide a second degree of clearance between the second float and an inner surface of the second pump casing, wherein the second degree of clearance is less than the first degree of clearance.

10. The system of claim 9, wherein each of the upper and lower housing rings each include:

a circumferential groove; and an O-ring positioned in each said circumferential groove.

11. The system of claim 9, further comprising a screen positioned over the inlet.

12. The system of claim 9, further comprising:

a poppet; and a spider for containing the poppet, the spider being operatively coupled to the lower support ring.

13. The system of claim 9, further comprising:

a control rod; and a lever assembly movable in response to linear movement of the control rod.

14. The system of claim 13, further comprising first and second stop elements secured to the control rod and engageable by either the first float or the second float during use of the modular pump, the first stop element causing the lever assembly to turn on the modular pump in response to movement by either the first or second floats in a first linear direction, and the second stop element causing the lever assembly to turn off the modular pump in response to movement by either the first or second floats in a second linear direction opposite to the first linear direction.

15. A method for forming a modular fluid pump in a selected one of first and second configurations, the method comprising:

providing a first pump casing having a first diameter;

providing a second pump casing having a second diameter smaller than the first diameter;

providing a tubular frame;

arranging a first float positioned over the tubular frame for sliding longitudinal movement along the tubular frame, and operatively securing the first pump casing to the tubular frame over the first float, when the modular pump is to be configured in a first configuration, to thus provide a first degree of clearance between the first float and an inner surface of the first pump casing;

arranging a second float over the tubular frame in place of the first float, and securing a second pump casing having a second diameter different from the first diameter to the tubular frame, in place of the first pump housing, when the modular pump is to be configured in a second configuration, to thus provide a second degree of clearance between the second float and an inner surface of the second pump casing.

16. The method of claim 15, further comprising coupling an upper housing ring and a lower housing ring to the tubular frame to support the first pump casing from the tubular frame.

17. The method of claim 16, further comprising coupling an upper support ring and a lower support ring to the tubular frame to support the second pump casing from the tubular frame.

18. The method of claim 15, further comprising using a poppet and a spider for containing the poppet, the spider being operatively coupled to the lower support ring, to help control an admittance of fluid into the modular pump.

* * * * *